United States Patent [19]

Ozeki et al.

[11] Patent Number: 4,717,400

[45] Date of Patent: Jan. 5, 1988

[54] COMBINED MOISTURE SEPARATOR AND REHEATER

[75] Inventors: Toshiaki Ozeki; Kenji Satoh, both of Yokohama, Japan

[73] Assignee: Kabushiki Kaisha Toshiba, Kawasaki, Japan

[21] Appl. No.: 844,508

[22] Filed: Mar. 27, 1986

[30] Foreign Application Priority Data

Mar. 29, 1985 [JP] Japan ..... 60-65429
Nov. 29, 1985 [JP] Japan ..... 60-268858

[51] Int. Cl.[4] ..... B01D 53/26

[52] U.S. Cl. ..... 55/186; 55/193; 55/268; 55/442; 122/483; 122/488

[58] Field of Search ..... 55/185, 186, 193, 268, 55/269, 442–446; 122/483, 488–492

[56] References Cited

U.S. PATENT DOCUMENTS 3,574,303 4/1971 Rabas ..... 122/483
3,712,272 1/1973 Cannavos et al. ..... 122/483
3,713,278 1/1973 Miller et al. ..... 55/269
4,019,881 4/1977 Herzog et al. ..... 55/185
4,302,227 11/1981 Miller ..... 55/269
4,485,069 11/1984 Byerley ..... 122/483 X
4,522,156 6/1985 Chaix ..... 122/488 X
4,589,893 5/1986 Franzolini et al. ..... 55/269

*Primary Examiner*—Charles Hart
*Attorney, Agent, or Firm*—Schwartz, Jeffery, Schwaab, Mack, Blumenthal & Evans

[57] ABSTRACT

In a device for separating the moisture contained in the cycling steam discharged out of a steam turbine and reheating the low-temperature steam is disclosed, a central chamber is defined between a pair of moisture separating structures and the bottoms of the central chamber, and the separating structures are closed by a closure structure. A steam chamber which is in communication with the central chamber is defined by a pair of side walls and the upper edge of each of the pair of side walls is loosely fitted into a guide groove defined by a pair of spaced guide plates which in turn are securely joined to the inner surface of the cylindrical shell.

9 Claims, 3 Drawing Figures

COMBINED MOISTURE SEPARATOR AND REHEATER

BACKGROUND OF THE INVENTION

1. Field of the Art

The present invention relates to a combined moisture separator and reheater and more particularly a combined moisture separator and reheater capable of separating moisture contained in cycling steam discharged out of a nuclear power steam turbine.

2. Description of the Prior Art

In a nuclear power plant in which high-pressure turbines and low-pressure turbines are connected in series, steam discharged out of a high-pressure turbine is wet steam containing a large amount of moisture which not only causes erosion of the turbine blades but also reduces the turbine efficiency. Therefore, moisture must be separated from steam and the moisture-free steam must be fed into a low-pressure turbine. To this end, in a nuclear power plant, a combined moisture separator and reheater is interposed between a high-pressure turbine and a low-pressure turbine so that not only moisture contained in the steam discharged from the high-pressure turbine is separated and, at the same time, the moisturefree steam which has been reheated to a superheated state is fed into the low-pressure turbine. The moisture separator and reheater of the type described generally comprises a pair of moisture separators and reheater disposed in a single pressure shell and is disclosed in detail, for instance, in U.S. Pat. No. 3,712,272 granted to Carnavos et al., U.S. Pat. No. 3,713,278 granted to Miller et al. and U.S. Pat. No. 3,574,303 granted to Rabas.

According to the teaching of the invention of Carnavos et al. or Miller et al., a pair of moisture separator elements are disposed in a shell in the form of the letter V or inverted V and are therefore inclined relative to the vertical so that the moisture separation efficiency is decreased, whereby their length must be increased accordingly and they thus occupy a large space. As a result, there arises a problem in that the diameter of the shell cannot be reduced, and consequently the combined moisture separator and reheater cannot be made compact in size. In general, the combined moisture separator and reheater is installed on a floor upon which a steam turbine is mounted so that the diameter of the shell determines the height of the ceiling of the plant in which the steam turbines are housed. Accordingly, when the diameter of the shell is reduced, the construction cost of the turbine plant can be also reduced. U.S. Pat. No. 3,574,303 discloses a pair of moisture separating structures disposed vertically and spaced apart from each other, but a pair of tubular manifolds are received in suitable openings in the end portion and extend longitudinally into the outer chambers respectively, whereby they become obstructive to reduction in diameter of the shell. In addition, since the tubular outlet fitting for discharging drain is opening into the central chamber defined between the pair of moisture separating structures so that there arises a problem in that steam which has flowed through the moisture separating structures into the central chamber absorbs and entrains part of the drain due to the ejector effect, and consequently it becomes difficult to completely separate moisture from the cycling steam.

Furthermore, in the combined structure separator and reheater of the type described above, the temperature difference between the upper and lower wall portions of the shell reaches a value as high as 70° C. in the case of the rated load operation and as high as 120° C. in the case of a partial load operation because of the increase in temperature of the cycling steam. As a consequence the shell is caused to deform in the form of a humpback resulting in the damages to the joints between the shell and the partition walls which define a steam chamber.

SUMMARY OF THE INVENTION

In view of the above, one of the objects of the present invention is to provide a combined moisture separator and reheater which can efficiently separate moisture contained in the cycling steam and reheat the moisture-free steam.

Another object of the present invention is to provide a combined moisture separator and reheater in which the leakage of steam through the joints between side walls and the shell which define a steam passage through which the steam flows to be reheated can be prevented.

To the above and other ends, the present invention provides a combined moisture separator and reheater comprising: an axially elongated cylindrical shell having closed opposite ends; a pair of horizontal partition plate for dividing the interior of the cylindrical shell into an upper chamber and a lower chamber; a pair of moisture separating structures extended in the lower chamber of the shell in the axial direction thereof and spaced apart from each other by a suitable distance to define a central chamber therebetween; a closure structure which closes the bottoms of the central chamber and the moisture separating structures and cooperates with the shell so as to define a steam passage between the shell and the closure structure; a pair of side walls disposed in the upper chamber of the shell and spaced apart from each other by a suitable distance so as to define a steam passage therebetween; connecting means for loosely joining the upper edge of each of said pair of side walls to said shell; and at least one reheater disposed in the steam passage for reheating the moisture-free steam.

With the combined moisture separator and reheater of the above described construction, wet steam discharged from a high-pressure steam turbine is fed into the cylindrical shell through wet steam inlets and impinges against the lower wall of the closure structure so that the steam is divided into the right and left steam flows. The steam flows are redirected toward the moisture separating structures and while the steam flows are passing through the moisture separating structures, the water droplets entrained in the steam flows are trapped by separator elements and the trapped water droplets flow into a drain chamber. The moisture-free steam having a low humidity flows from the central chamber into the steam channel upwardly and is reheated by a first stage of reheating tubes and a second stage of reheating tubes and discharged into a low-pressure turbine.

As described above, according to the present invention, the bottoms of the central chamber and the moisture separating structures are completely enclosed by the closure structure and wet steam introduced through the wet steam inlets into the cylindrical shell is divided into the right and left steam flows which in turn are redirected toward the moisture separating structures, respectively. The trapped water droplets are collected in the drain chamber defined within the closure structure. As a result, no drain is entrained in the moisture-free steam having a low humidity so that the moisture-free steam can be superheated to elevated temperature by the reheater and then, the moisture-free steam can be fed into the low-pressure turbine in the next stage.

Furthermore, according to the present invention, the upper edge of each of the side walls which defines the steam passage is loosely fitted into a guide groove defined by a pair of spaced apart guide plates securely attached to the inner cylindrical surface of the shell. As a result, even when the shell is deformed in the form of a humpback due to the heating of cycling steam, the upper edges of the side wall only slide in the guide grooves so that damage of the joints between the inner cylindrical surface of the shell and the side walls can be prevented. Moreover, according to the present invention, balance holes are formed through the upper portions of the side walls so that the pressure in the steam passage is balanced with the pressure in the upper chamber. As a consequence, the low-temperature cycling steam is prevented from flowing from the upper chamber into the steam passage due to the pressure difference therebetween, and deformation of the side walls are prevented. The horizontal partition plates 17 prevent short pass flow of low-temperature steam which flow from the lower chamber to the steam passage through the balance holes, so that the decrease in overall efficiency of the combined moisture separator and reheater due to the leakage of low-temperature cycling steam can be prevented.

The nature, utility, and further features of the present invention will be best understood by reference to the following description taken in connection with the accompanying drawings.

DETAILED DESCRIPTION OF THE PREFERRED EMBODIMENT

Figure 1:
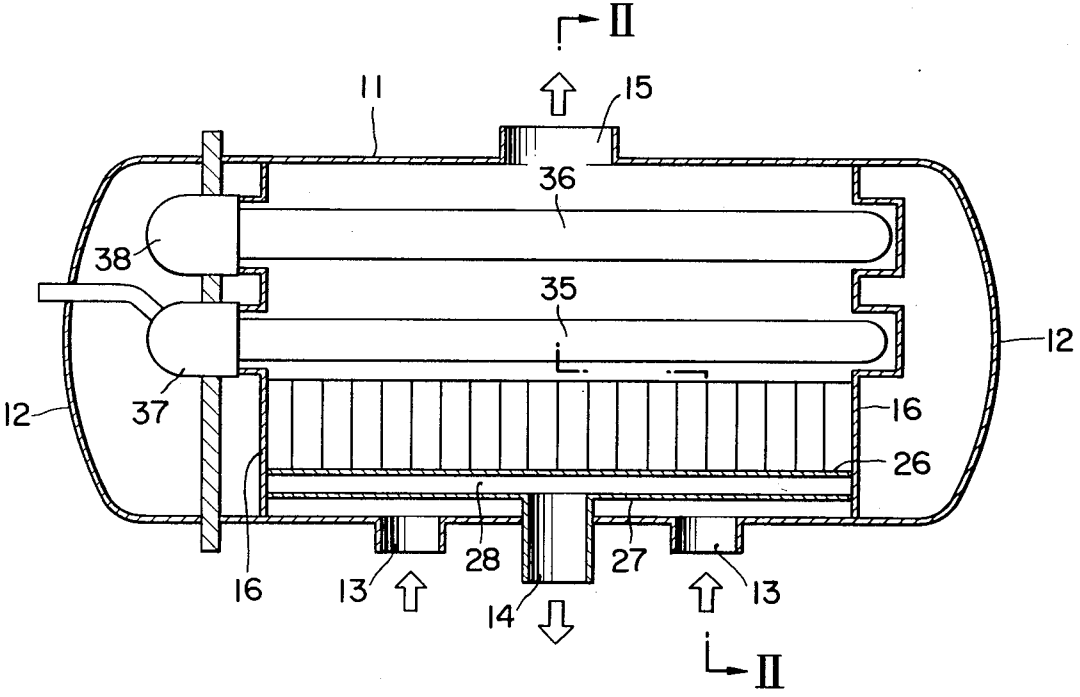
FIG. 1 is a side elevation in longitudinal section, of one example of the combined moisture separator and a two-stage reheater in accordance with the present invention.
Figure 2:
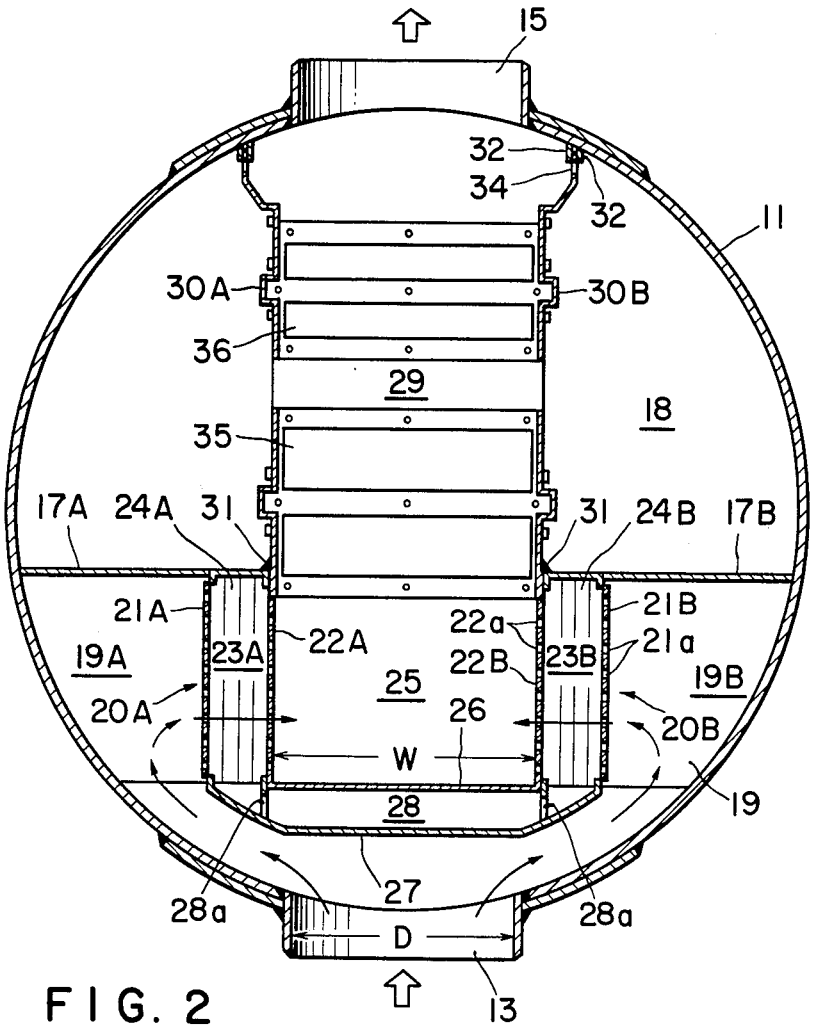
FIG. 2 is a transverse cross section taken along line II—II of FIG. 1.

Referring now to FIGS. 1 and 2 of the drawings, reference numeral 11 designates a single cylindrical shell of a combined moisture separator and reheater in accordance with the present invention, both ends of which are formed integral with and closed by hemispherical end cover 12. Wet steam inlets 13 and a drain outlet 14 are provided at the lower portion of the cylindrical shell 11 while a superheated steam outlet 15 is provided at the upper part of the cylindrical shell 11. Vertical or upright end partitions 16 are disposed adjacent to the end cover 12. The wet steam inlets 13 and the drain discharge outlet 14 are located between the end partitions 16.

As best shown in FIG. 2, the interior of the pressure shell 11 is divided by a pair of horizontal partition plates 17 into an upper chamber 18 and a lower chamber 19. Within the lower chamber 19, a pair of moisture separator structures 20A and 20B are disposed symmetrically on opposite lateral sides of the axes of the wet steam inlets 13 and are spaced apart from each other by a suitable distance in the horizontal transverse direction.

Each of the moisture separator devices 20A and 20B comprises a front perforated plate 21 and a rear perforated plate 22 which are erected upright and spaced apart from each other by a specific distance and extend in the lognitudinal or axial direction of the cylindrical shell 11. A separating chamber 23 is defined between the front and rear perforated plates 21 and 22, and a plurality of separator elements 24 are disposed in the separating chamber 23 as in the case of the prior art and spaced apart from each other by a very close distance. These separator elements 24 are known as wiggle plates or zig-zag plates in the case of an inertial separation type. The front perforated plate 21 is formed with a large number of ports **21*a* while the rear perforated plate 22 is formed with a large number of ports 22*a*. The opening areas of these ports 21*a* and 22*a* become smaller as they approach the ends of the shell 11 so that the steam flows at a uniform flow rate throughout the shell 11** in its axial or longitudinal direction.

A central chamber 25 is defined between the pair of opposing rear perforated plates 22A and 22B. The width W of the central chamber 25 can be arbitrarily selected so that it is possible to select a width W greater than the diameter D of the wet steam inlet 13. The bottom of the central chamber 25 is closed by a top wall 26 of a drain chamber 28, and the open bottoms of the moisture separator structures 20A and 20B are closed by a bottom or lower plate 27 of the drain chamber 28. The upper and lower walls 26 and 27 cooperate to define a closed structure which serves to prevent the interference between the wet steam flows flowing through the wet steam inlets 13 and the steam flows flowing inwardly through the moisture separator structures 20A and 20B.

The drain chamber 28 is defined between the upper and lower walls 26 and 27, and the drain discharge outlet 14 is positioned at the mid-point of the length of the drain chamber 28. Drain flowing down along the separator elements 24A and 24B flows into the drain chamber 28 through passages **28*a*. The lower wall 27 of the drain chamber 28 is extended immediately above wet steam inlets 13 and serves to uniformly distribute the wet steam flowing into the shell 11 through the wet steam inlets 13 into the left and right lower chambers 19A and 19B**, respectively.

Figure 3:
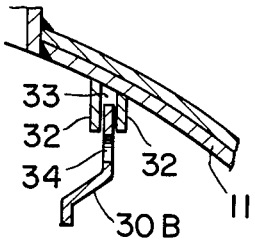
FIG. 3 is a fragmentary sectional view of the sealing portion of a side panel or wall.

The central chamber 25 is communicated with the superheated steam outlet 15 through a vertical steam passage 29 which is defined by a pair of opposing side walls 30A and 30B disposed in the upper chamber 18. The lower edges of the side walls 30 are securely joined to the horizontal partition plates 17A and 17B, respectively, by seal welding as indicated by 31 in FIG. 2, while each of the upper edges thereof, as best shown on enlarged scale in FIG. 3, is loosely fitted into a guide groove 33 defined by a pair of opposing guide plates 32 which in turn are securely attached to the inner cylindrical surface of the shell 11. As best shown in FIG. 3, the upper portions near the upper edges of the side walls are formed with balance holes 34 serving for intercommunication between the vertical steam passage 29 and the upper chambers 18A and 18B. A first stage reheating tubes 35 and a second stage reheating tubes 36 which constitute a pair of reheater are disposed within the steam passage 29 and are vertically spaced apart from each other by a predetermined distance. Each of the reheating tubes 35 and 36 comprises a plurality of U-shaped pipes and, at best shown in FIG. 1, the open ends of the U-shaped pipes are connected to first and second stage reheated superheated steam headers 37 and 38.

With the combined moisture separator and reheater of the above-described construction, the wet steam discharged out of a high pressure turbine flows through the wet steam inlets 13 into the pressure shell 11, impinges against the lower wall 27 of the drain chamber 28 and is divided into the left and right flows flowing into the left and right lower chambers 19A and 19B, respectively. Then the steam flows are redirected radially inwardly to flow through the moisture separator structures 20A and 20B into the central chamber 25. Because of the openings of the front perforated plates 21A and 21B, the wet steam uniformly flows in the longitudinal direction of the shell 11 and is introduced into the spaces between the separator elements 24 whereby, because of the difference in specific gravity, water drops are trapped by the separator elements and flow down into the drain chamber 28 and are recovered through the drain discharge outlet 14.

The steam now free from moisture passes through the rear perforated plates 22A and 22B and flows uniformly into the central chamber 25 along the longitudinal direction of the shell 11. The steam having a relatively low humidity which has flowed into the central chamber 25, flows upwardly in the steam passage 29 and is sequentially reheated by the first stage reheating tubes 35 and the second stage reheating tubes 36. The steam thus reheated is introduced through the superheated steam outlet 15 into a low pressure turbine. As a consequence of the temperature rise caused by heating of the cycling steam, the upper portion of the shell 11 is deformed in the form of a humpback. This deformation is pronounced especially at the portion adjacent to the superheated steam outlet 15. However, as described above, the upper sides of the side walls 30A and 30B which define the steam passage 29 are loosely fitted into the guide grooves 33, respectively, defined by the opposing guide plates 32 which in turn are securely attached to the inner cylindrical surface of the shell 11 (See FIG. 3), so that even when the shell 11 is deformed in shape, the upper edges of the side walls 30 are caused only to slide in the guide grooves 33. Therefore, unlike the prior art in which the upper edges of the side walls are welded to the inner cylindrical surface of the shell, the joint between the upper edges of the side walls 30 and the inner cylindrical surface of the shell 11 will not be damaged at all.

Since the intercommunication between the steam passage 29 and the upper chambers 18A and 18B through the balance holes 34 fromed through the side walls 30A and 30B is ensured, even when the pressure loss of the cycling steam occurs because of the reheating by the first stage reheating tubes 35 and the second stage reheating tubes 36 in the steam chamber 29, the pressure in the steam passage 29 adjacent to the superheated steam outlet 15 is substantially balanced with the pressure in the upper chambers 18. Furthermore, since the upper chambers 18A and 18B are separated from the drain chamber 28 by means of the partitions 16 and the horizontal partition plates 17A and 17B, the side walls 30A and 30B and the shell 11 and the horizontal partition plates 17A, 17B are joined together by seal welding, the pressures in the upper chambers 18A and 18B are not higher than the pressure in the drain chamber 28 or at the wet steam inlets 13. As a result, in the normal state, the pressure in the steam passage 29 is balanced with that in the upper chamber 18A and 18B whereby flowing of the low-temperature cycling steam from the upper chambers 18A and 18B through the balance holes 34 into the steam passage 29 can be prevented.

What is claimed is:

1. A combined moisture separator and reheater comprising:

an axially elongated cylindrical shell having sealed opposite ends;

a pair of horizontal partition plates for dividing the interior of said cylindrical shell into an upper chamber and a lower chamber;

a pair of moisture separating structures extending in the lower chamber of said cylindrical shell in the axial direction thereof and sufficiently spaced apart so as to define a central chamber therebetween;

a closure structure which seals the bottoms of said central chamber and said pair of moisture separating structures and defines an incoming steam passage between said bottoms of said central chamber and said moisture separating structures and said shell;

a pair of side walls disposed in said upper chamber of said shell sufficiently spaced apart so as to define a steam passage therebetween;

at least one reheater disposed in said steam passage for reheating moisture-free steam; and connecting means for loosely joining the upper edge of each of said side walls to said shell so as to prevent damage to the connection between said shell and said side walls upon thermal deformation of said shell.

2. A combined moisture separator and reheater as set forth in claim 1 wherein each of said pair of moisture separating structures comprises a front perforated plate and a rear perforated plate each of which has an array of openings through which the steam passes and which are disposed on the opposite sides of a separation chamber in parallel with each other; and wherein moisture separator elements are packed in said separation chamber.

3. A combined moisture separator and reheater as set forth in claim 1 wherein said shell has at least one wet steam inlet disposed at the lower portion thereof and said closure structure is symmetrically shaped with respect to a plane extending axially from said shell and including the center axis of said wet steam inlet so that the flow of the wet steam introduced through said wet steam inlet into said shell is divided into two substantially equivalent flows.

4. A combined moisture separator and reheater as set forth in claim 1 wherein said closure structure comprises an upper wall closing the bottom of said central chamber and a lower wall closing the bottoms of said pair of moisture separating structures, said upper and lower walls of said closure structure defining a drain passage therebetween.

5. A combined moisture separator and reheater as set forth in claim 1 wherein said connecting means comprises a pair of guide plates which are securely attached to the inner cylindrical surface of said shell and define a guide groove therebetween into which said upper edge of each of said side walls is loosely fitted and slidable therebetween.

6. A combined moisture separator and reheater as set forth in claim 1 wherein balance holes are formed at the upper portions of said side walls to establish pressure balance between said steam passage and said upper chamber.

7. A combined moisture separator and reheater as set forth in claim 1, wherein each of the lower edges of said side walls is securely joined to one of said pair of horizontal partition plates, respectively.

8. A combined moisture separator and reheater as set forth in claim 2, wherein said array of perforated plate openings have a diameter sufficient to provide a uniform steam flow rate throughout said shell in the axial direction.

9. A combined moisture separator and reheater as set forth in claim 1, wherein the width of said central chamber is greater than the diameter of an incoming steam inlet.

* * * * *